US005702017A

United States Patent [19]

Goncalves

[11] Patent Number: 5,702,017

[45] Date of Patent: *Dec. 30, 1997

[54] COMBINATION OF A ROW OF CONTAINERS AND A STRIP OF CAPS, AND ASSEMBLY OF A CONTAINER AND CAP

[75] Inventor: Antonin Goncalves, Montmorency, France

[73] Assignee: L'Oreal, Paris, France

[ * ] Notice: The portion of the term of this patent subsequent to Apr. 7, 2014, has been disclaimed.

[21] Appl. No.: 601,152

[22] Filed: Feb. 13, 1996

Related U.S. Application Data

[63] Continuation of Ser. No. 224,318, Apr. 7, 1994, Pat. No. 5,544,778.

[30] Foreign Application Priority Data

Apr. 26, 1993 [FR] France ..... 93/04881

[51] Int. Cl.[6] ..... B65D 21/02; B65D 41/17

[52] U.S. Cl. ..... 220/23.4; 215/318; 215/332; 220/23.83; 206/820; 53/490; 53/321

[58] Field of Search ..... 215/317, 318, 215/337, 332, 228, 306, 330, 331; 220/23.2, 23.4, 23.83, 212, 375, 660, 662, 281, 282, DIG. 13, 568; 206/820; 53/489, 490, 331.5, 317, 321

[56] References Cited

U.S. PATENT DOCUMENTS

| | | | |
|---|---|---|---|
| 1,190,196 | 7/1916 | Schweinert et al. . | |
| 3,083,429 | 4/1963 | Barlow et al. . | |
| 3,223,269 | 12/1965 | Williams | 215/318 |
| 3,302,854 | 2/1967 | Midgley et al. . | |
| 3,794,200 | 2/1974 | Marks . | |
| 4,157,762 | 6/1979 | Robinson . | |
| 4,790,453 | 12/1988 | Fontana et al. . | |
| 5,050,762 | 9/1991 | Giorgi . | |
| 5,092,474 | 3/1992 | Leigner . | |
| 5,246,133 | 9/1993 | James . | |
| 5,285,912 | 2/1994 | Molinaro | 215/318 X |
| 5,544,778 | 8/1996 | Goncalves | 220/23.4 |

FOREIGN PATENT DOCUMENTS

| | | | |
|---|---|---|---|
| 0 147 951 | 7/1985 | European Pat. Off. . | |
| 0 176 206 | 4/1986 | European Pat. Off. . | |
| 1 081 275 | 12/1954 | France . | |
| 1 211 229 | 3/1960 | France . | |
| 1 251 707 | 12/1960 | France . | |
| 2381678 | 10/1978 | France | 215/318 |
| 2482566 | 8/1983 | France . | |
| 2 182 639 | 5/1987 | United Kingdom . | |
| 2 203 729 | 10/1988 | United Kingdom . | |

*Primary Examiner*—Allan N. Shoap
*Assistant Examiner*—Nathan Newhouse
*Attorney, Agent, or Firm*—Staas & Halsey

[57] ABSTRACT

Combination of a row of containers and a strip of caps, each of the containers and caps being respectively joined by breakable links allowing the joined strip of caps to be placed on necks of the joined row of containers by a translational movement parallel to axes of the containers. Click-fasteners are provided on the container necks to interact with complementary click-fasteners formed on the caps. The caps close the containers in a leaktight fashion when snapped into place. The links between each container/cap combination can then be broken to separate each container/cap assembly from the other container/cap assemblies. The click-fasteners also allow each cap to be removed from the corresponding container.

8 Claims, 2 Drawing Sheets

COMBINATION OF A ROW OF CONTAINERS AND A STRIP OF CAPS, AND ASSEMBLY OF A CONTAINER AND CAP

This application is a continuation of application Ser. No. 08/224,318, filed Apr. 7, 1994, now U.S. Pat. No. 5,544,778.

BACKGROUND OF THE INVENTION

The invention relates to a combination of a row of bottle-type containers joined to one another by linking means which can be easily broken, with their axes parallel, in particular situated in the same plane, and of a strip of caps joined to one another by linking means which can also be broken easily, in an arrangement similar to that of the containers, so that the strip of caps can be placed on the necks of the containers in the row by a translational movement parallel to the axes of the containers.

The invention relates, more particularly, but not exclusively, to such a combination for packaging a series of mini-bottles intended to contain a small quantity of colorant, a hair colorant, so that the user can carry out an allergy test on part of the skin.

These mini-bottles are attached to the packaging of the actual hair colorant or dye.

FR-A-2 482 566 discloses a combination of containers and caps of the above-defined type, in which combination the containers are sealed beforehand with a top before a strip of extra caps is fitted, each individual extra cap covering a top sealing the container.

It takes a relatively long period of time to fit the sealing tops, whereas it is much quicker to fit the strip of extra caps as a single unit.

SUMMARY OF THE INVENTION

The object of the invention is, above all, to provide a combination of the above-defined type in which the operations required to seal the containers are as quick as possible. It is furthermore desired that the combination of the row of containers and the strip of caps remains inexpensive and easy to use.

According to the invention, a combination of the above-defined type is characterized in that click-fastening means are provided on the necks of the containers to interact with complementary click-fastening means of the caps, the assembly being such that when the caps are connected in a strip, when the strip of caps is placed above the row of containers, the click-fastening means of the caps are placed in the correct angular position relative to those of the containers, the caps being designed to close the container in a leaktight fashion by being snapped into place, the click-fastening means furthermore being designed to allow the container to be opened by rotating the lid once the container, equipped with its cap, has been separated from the row.

The click-fastening means of the container preferably comprise at least one projecting portion of a helical thread provided on the neck of the container, with a stop at each end of the thread portion, whilst the cap comprises at least one catch capable of clicking into place behind the thread portion by fitting in between the stops.

Each cap advantageously comprises, on its wall, above the catch, a window which increases the elasticity of the wall in this area so as to facilitate its deformation when the strip of caps is clicked onto the row of containers.

The thread portion of the neck of the container is bordered above by an inclined surface, whilst the lower face of the catch of the cap is bordered by an inclined wall intended to interact with the abovementioned inclined surface.

Each cap preferably comprises at least one male slope capable of coming into a position, after click-fastening, above the thread portion provided on the neck of the container, the interaction of this slope and the thread, during a rotational movement, raising the cap relative to the container, while the stops are passed by the catch of the cap, which deforms elastically.

An inner skirt is provided beneath the lid of each cap for engaging leaktightly, by translational movement, inside the neck of the associated container.

The click-fastening means are preferably diametrically opposite on the necks of the containers and on the caps, and are arranged symmetrically relative to the plane of the axes of the containers in the row.

The invention also relates to the assembly of a bottle-type container comprising, on its neck, at least one projecting thread portion, with a stop at each end of the thread portion and with a cap comprising at least one catch capable of clicking into place behind the thread portion by fitting in between the stops, it being possible for the cap to be separated from the container by rotating it.

The cap can comprise on its wall, above the catch, a window and at least one male slope capable of coming into a position, after click-fastening, above the thread portion provided on the neck of the container.

BRIEF DESCRIPTION OF THE DRAWINGS

Apart from the features explained above, the invention includes of a certain number of other features which will be dealt with in more detail below, with reference to an illustrative embodiment described with reference to the attached drawings, but no limitation being implied.

Lastly.

DESCRIPTION OF THE PREFERRED EMBODIMENTS

Figure 1:
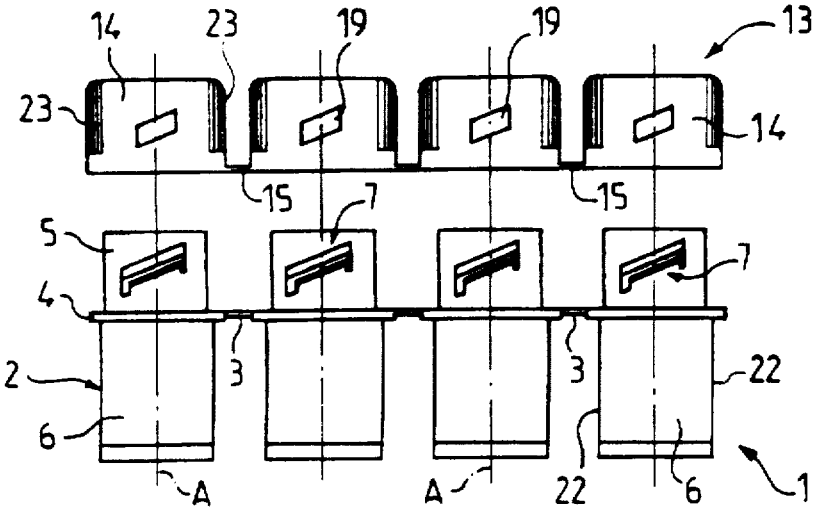
FIG. 1 of these drawings is a view in elevation of a row of containers consisting of mini-bottles, and of the strip of caps, before click-fastening.

With reference to FIG. 1 of the drawings, a row 1 of containers 2 can be seen, including bottles of small dimensions or mini-bottles, intended to package the quantity of a hair colorant required for an allergy test.

The bottles 2 are joined together by linking means which can be easily broken, the linking means advantageously including tongues 3. Each tongue connects two adjacent bottles at a flange 4 which marks the separation between the neck 5 and the body 6 of the bottle. The bottles 2 are joined in such a way that their axes A are parallel to one another and situated in the same plane. The tongues 3 are aligned in the plane of the axes of the bottles.

Figure 3:
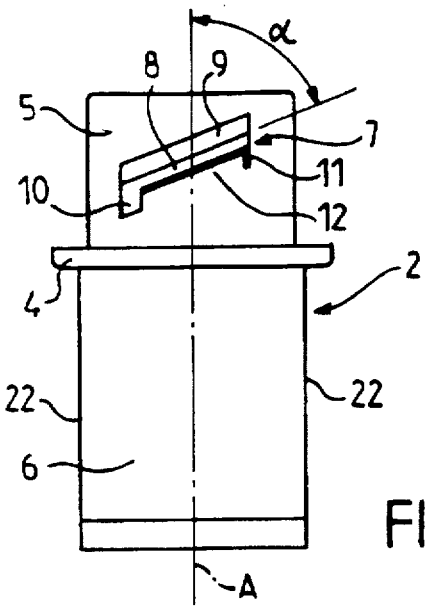
FIG. 3 is a view in elevation, on a larger scale, of a container.

Each neck 5, cylindrical in shape with a circular cross-section, includes click-fastening means 7, clearly visible in FIG. 3, with a projecting helical thread portion 8 on the cylindrical surface of the neck. This thread portion 8 is bordered above by an inclined surface 9, which gradually joins the thread portion to the cylindrical surface of the neck 5. The angle α of the thread portion 8 with the direction of the generatrices of the neck 5 is chosen appropriately; in the example in question, this angle is of the order of 70°. The pitch of the thread may be of the order of 8 mm.

A stop 10, 11, parallel to the direction of the generatrices of the neck and projecting on the outer surface of the neck, is provided at each end of the thread portion 8. The stops 10, 11 extend towards the bottom of the bottle 2, on the opposite side to the inclined surface 9. A housing 12 is bordered laterally by stops 10 and 11 and above by the thread portion 8.

In practice, two thread portions 8 similar to that described above and diametrically opposite each other are provided on the neck 5. These thread portions 8 are placed symmetrically relative to the plane of the axes A of the row 1.

This row is intended to be combined with a strip 13 of caps 14 joined to one another by linking means consisting of tongues 15 which can also be easily broken. The caps 14 in the strip 13 are arranged in a similar way to the bottles 2 of the row 1, in other words the axes of the caps 14 are situated in the same plane and the spacing between the axes of these caps is the same as for the bottles 2. Thus, by placing the strip 13 correctly above the row, the axis of each cap can be aligned with the axis of each corresponding bottle 2 so as to fit the caps 14 on the necks 5 by means of a translational movement parallel to the axes A.

Figure 2:
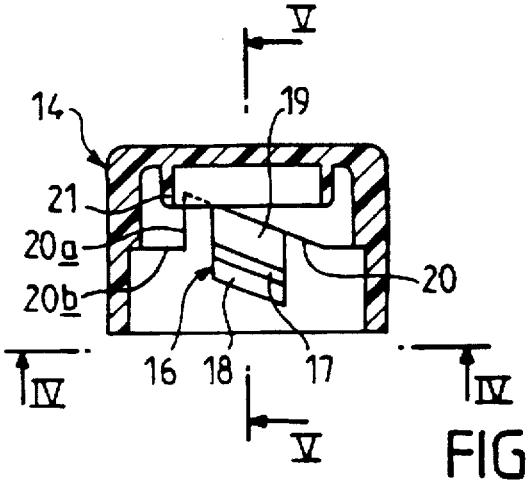
FIG. 2 is an axial vertical section, on a larger scale, of a cap.
Figure 4:
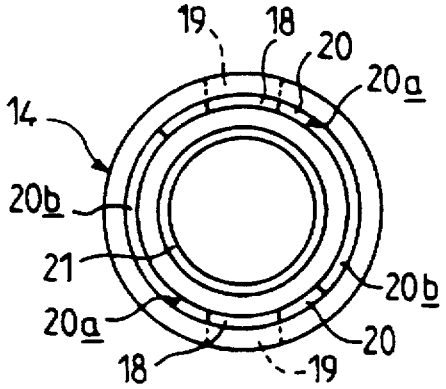
FIG. 4 is a view along the line IV—IV in FIG. 2.
Figure 5:
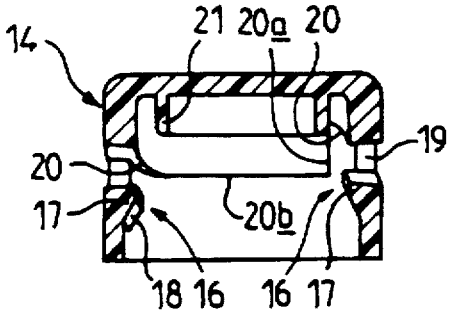
FIG. 5 is a section along the line V—V in FIG. 2.
Figure 6:
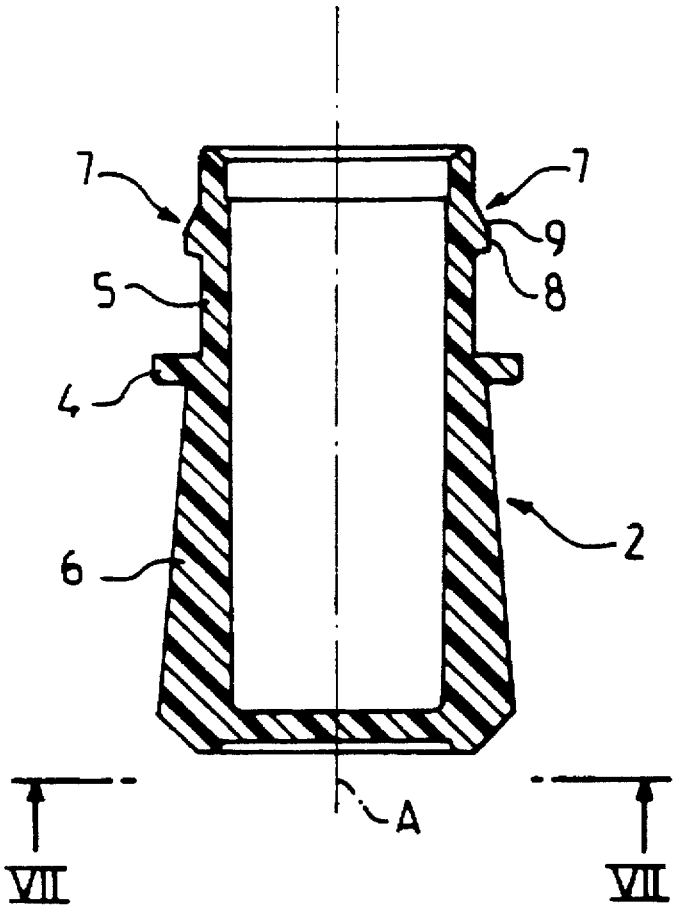
FIG. 6 is a vertical axis section of the container.
Figure 7:
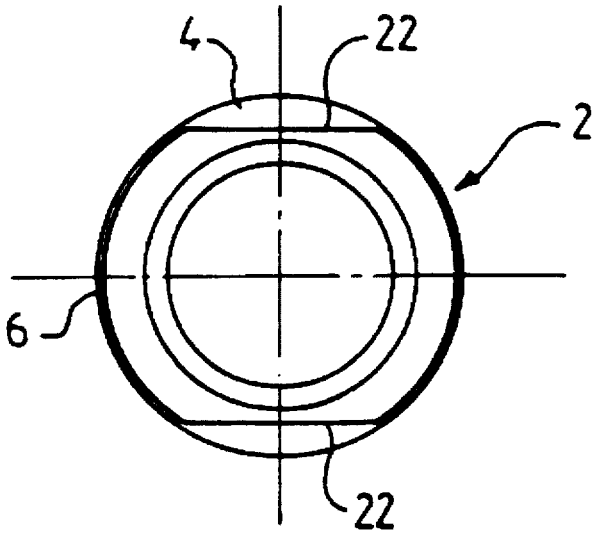
FIG. 7 is a view along the line VII—VII in FIG. 6.

Each cap 14 comprises, on its inner wall, click-fastening means 16 which complement the click-fastening means 7 of the bottles 2. The click-fastening means 16 include, for each cap, two diametrically opposite catches 17 (see FIGS. 2 and 5) which project from the inner cylindrical surface of the bottle. Each catch 17 includes a portion of a helical rib which has the same inclination as the thread portion 8 and is capable of fitting into place beneath this thread 8.

The length of the catch 17 is slightly less than the distance between the end stops 10, 11 so that the catch 17 can engage between these stops and lock the cap in rotation relative to the bottle, with a reduced angular play.

The lower face of the catch 17 is bordered by an inclined wall 18 which has substantially the same angle of inclination as the surface 9 with which it is intended to interact during the click-fastening operation.

Each cap 14 has, in its cylindrical wall, above the catch 17, a window 19 in the shape of a parallelogram, having the same angular extent as the catch 17 and limited by the same generatrices. Two windows 19 are thus provided, diametrically opposite each other, symmetrically relative to the plane of the parallel axes of the caps 14, corresponding with two diametrically opposite catches 17.

Two male slopes 20, diametrically opposite each other, are provided on the inner wall of each cap 14, above each catch 17, each slope 20 having the same inclination, relative to the generatrices, as the catch 17. The distance along the generatrices between the catch 17 and the slope 20 is such that when the thread portion 8 is lodged between the catch 17 and the slope 20, there is virtually simultaneous contact between the catch 17 and the lower face of the thread portion 8, and between the slope 20 and the inclined surface.

The angular extent of the slope 20 is considerably greater than that of the catch 17, and may be of the order of 80°.

The upper end of each slope 20 nearest to the upper transverse wall of the cap 14 is followed by a step **20*a* parallel to the generatrices. This step 20*a* is extended by a curved shoulder 20*b* situated in a plane perpendicular to the axis of the cap 14. This shoulder 20*b* connects up with the starting point of the other diametrically opposite slope 20**.

The cap 14 comprises, beneath its lid, a skirt 21 capable of engaging in leaktight fashion in the neck 5 of the bottle.

The bottles 2 can be manufactured using an injection moulding process, for example in rows of ten, in an opening mold which allows the thread portions 8 with the stops 10, 11 to be formed.

The strips 13 of caps 14 can also be manufactured using an injection mold process, there being the number of caps in a strip as bottles in a row, for example ten as indicated above. The caps can be manufactured in an opening mold which allows two opposite male slopes to be formed by virtue of an upper recess.

The bottles are packaged and used as follows.

Starting with the row I of bottles 2, they are filled with the quantity of product intended for each bottle.

Then, by placing the strip 13 of caps 14 correctly above the abovementioned row 1, in a translational movement in a direction parallel to the axes of the bottles, a neck 5 is engaged in each corresponding cap 14 integral with the strip 13, and each cap is click-fastened onto the corresponding neck.

It should be noted that by placing the strip 13 above the row 1, the click-fastening means 16 of the caps are positioned correctly relative to the click-fastening means 7 of the bottles.

The movement of lowering the caps relative to the bottles can be controlled easily in an automatic fashion so that the bottles 2 of the row I are closed extremely simply and quickly.

When a cap 14 is lowered relative to the corresponding bottle 2, the lower inclined wall 18 of a catch 17 comes into contact with the upper inclined surface 9 of the thread portion 8. The interaction of these two inclined surfaces in response to the downward force exerted on the cap 14 allows the cap to deform elastically. This deformation is facilitated by the presence of the windows 19.

The catch 17 passes the thread portion 8 and gets elastically into place beneath this thread portion by fitting in the housing 12.

Once this click-fastening operation is complete, the bottles 2 are closed leaktightly, the skirt 21 of each cap being engaged in the neck 5 of the corresponding bottle.

After the row of bottles has been closed, the tongues 3, 15 interconnecting the bottles 2 and the caps 14 are cut using an appropriate tool in order to obtain individual bottles 2 which each correspond to one mini-quantity. This mini-quantity is attached to the packaging of the actual hair colorant.

When using the shampoo, an allergy test is carried out using this mini-quantity.

To open the bottle 2 the user just needs to unscrew the cap 14 relative to the bottle 2. By rotating the cap with a sufficient force, the user causes the catch 17 to pass the upper stop 11. The slopes 20, interacting with the surfaces 9 of the thread portions 8, free the cap 14 from the bottle.

To make the bottle easier to hold, plane faces 22 may be provided which have a substantially triangular contour and diametrically opposite each other on the outer frustoconical surface of each bottle. These faces are substantially at 90° relative to the center of the thread portion 8.

Grooves 23, parallel to the generatrices, are advantageously provided on the cap in the diametrically opposite zones offset by substantially 90° relative to the windows 19, in order to make the cap easier to turn.

The invention makes it possible to prepare a mini-quantity of colorant at a very low price and very quickly and effectively. Its use is facilitated by unscrewing the cap to open the bottle.

I claim:

1. Combination, comprising:

(a) a row of containers, each container having a neck, being joined to one another by at least one link which can be easily broken, and an axis which is parallel and in the same plane as the axis of each other container, wherein each neck includes at least one click-fastener, and wherein the click-fasteners on the container include at least one projecting, inclined thread portion; and (b) a strip of caps, each cap being joined to one another by at least one link which can be easily broken, and an axis which is parallel and in the same plane as the axes of each other cap, wherein each cap includes at least one click-fastener that is complementary to the at least one click-fastener on the neck, wherein the linked strip of caps is removably attached to the necks of the linked containers by only a translational movement of the caps relative to the containers, parallel to the axes of the containers, with the axes of the containers and the caps being aligned, whereupon the click-fasteners of the caps snap into place against the click-fasteners of the containers, and close the containers in sealing relation and, after each container and corresponding attached cap are separated from the row and strip, respectively, by breaking the respective links, the caps can be removed from the necks by rotational movement of each cap relative to each corresponding neck, via the inclined thread positions of the click-fasteners allowing the rotational movement of the cap, wherein at least one projecting thread portion has a stop at each end thereof, and wherein the click-fasteners on the cap each comprises at least one catch capable of being received at the thread portion, between the stops.

2. Combination according to claim 1, wherein each cap comprises at least one male ramp which comes into a position above the thread portion after the translational movement, an interaction of this ramp and the thread, during the rotational movement, raising the cap relative to the container, while the stops are passed by the catch of the cap, which deforms elastically.

3. Combination according to claim 1, wherein each cap comprises an inner skirt for engaging in sealing relation, by the translational movement, with an inside of the neck of a corresponding container.

4. Combination according to claim 1, wherein the at least one click-fastener is a plurality of click fasteners arranged diametrically opposite on the necks of the containers and on the caps, and are arranged symmetrically relative to a plane of the axes of the row of containers.

5. Combination, comprising:

(a) a row of containers, each container having a neck with a click-fastener including a projecting, inclined thread portion, being joined to one another by a breakable link, and having an axis which is parallel and in the same plane as the axis of each other container; and (b) a strip of caps, each cap including a click-fastener that is complementary to the click-fastener on the neck, being joined to one another by a breakable link, and having an axis which is parallel and in the same plane as the axis of each other cap, wherein the linked strip of caps is removably attached to the necks of the linked containers by only a translational movement of the caps relative to the containers parallel to the axes of the containers, while the axes of the containers and the caps are aligned, such that the click-fasteners on the necks snap into place against the complementary click-fasteners on the caps and the caps close the containers in sealing relation, and, after each container and corresponding attached cap are separated from the row and strips, respectively, by breaking the respective links, each cap can be removed from each respective neck by rotational movement of the cap relative to the neck, via the inclined thread positions of the click-fasteners allowing the rotational movement of the cap, wherein the projecting thread portion has a stop at each end thereof, and wherein the click-fasteners on the cap each comprise a catch capable of being received at the thread portion, between the stops.

6. Combination according to claim 5, wherein each cap comprises a male ramp which comes into a position above the thread portion after the translational movement, an interaction of this ramp and the thread portion, during the rotational movement, raising the cap relative to the container, while the stops are passed by the catch of the cap, which deforms elastically.

7. Combination according to claim 5, wherein each cap comprises an inner skirt for engaging in sealing relation, by the translational movement, with an inside of the neck of a corresponding container.

8. Combination according to claim 5, wherein the at least one click-fastener is a plurality of click fasteners arranged diametrically opposite on the necks of the containers and on the caps, and are arranged symmetrically relative to a plane of the axes of the row of containers.

* * * * *